US005192485A

United States Patent [19]

Kuramoto et al.

[11] Patent Number: 5,192,485

[45] Date of Patent: Mar. 9, 1993

[54] CONTINUOUS ANNEALING LINE HAVING CARBURIZING/NITRIDING FURNACE

[75] Inventors: Koshi Kuramoto; Tsuguhiko Nakagawa; Satoshi Shibuya; Takao Ogawa; Toshikazu Kaihara, all of Kurashiki; Kusuo Furukawa, Chiba, all of Japan

[73] Assignee: Kawasaki Steel Corp., Tokyo, Japan

[21] Appl. No.: 738,231

[22] Filed: Jul. 30, 1991

[30] Foreign Application Priority Data

Jul. 31, 1990 [JP] Japan ..... 2-202833
Nov. 30, 1990 [JP] Japan ..... 2-334147
Nov. 30, 1990 [JP] Japan ..... 2-334149

[51] Int. Cl.[5] ..... C23C 8/00

[52] U.S. Cl. ..... 266/80; 148/206; 148/207; 148/212

[58] Field of Search ..... 266/80; 148/16, 16.5, 148/16.6

[56] References Cited

U.S. PATENT DOCUMENTS 3,950,192 4/1976 Golland et al. ..... 148/16.5
4,704,167 11/1987 Ichida et al. ..... 148/153
4,836,864 6/1989 Murakami et al. ..... 148/16.5
4,971,634 11/1990 Shibata et al. ..... 148/16.5
5,019,182 5/1991 Arimi ..... 148/16.6
5,069,728 12/1991 Rancon et al. ..... 148/157
5,085,714 2/1992 Kitamura et al. ..... 148/16.6

FOREIGN PATENT DOCUMENTS 0082723 6/1980 Japan ..... 148/16

*Primary Examiner*—Upendra Roy
*Attorney, Agent, or Firm*—Bierman and Muserlian

[57] ABSTRACT

A continuous annealing line for annealing a cold-rolled strip of a ultra-low-carbon steel comprising a heating furnace for heating the strip which is fed continuously, with or without a soaking furnace following the heating furnace, a cooling furnace in which the heated steel strip is cooled, and a carburizing/nitriding furnace disposed between the heating furnace or the soaking furnace and the cooling furnace. The carburizing/nitriding furnace may be divided into a plurality of zones, each of which is provided with control means for controlling the carburizing/nitriding atmosphere and carburizing-/nitriding temperature in the zone. The continuous annealing line may further comprise a plurality of carburizing/nitriding furnaces and have an arrangement for conducting a switching between a mode in which the carburizing/nitriding furnace is used for carburizing/nitriding the steel strip and a mode in which the carburizing/cooling furnace is used for cooling the steel strip.

4 Claims, 6 Drawing Sheets

CONTINUOUS ANNEALING LINE HAVING CARBURIZING/NITRIDING FURNACE

BACKGROUND OF THE INVENTION

1. Field of the Invention

The present invention relates to a continuous annealing line for cold-rolled steel sheets and, more particularly, to a continuous annealing line having carburizing and nitriding furnaces which are disposed between a heating furnace or a soaking furnace and a cooling furnace and which continuously forms carbides, nitrides or carbonitrides on cold-rolled steel sheets.

2. Description of the Related Art

In recent years, the continuous annealing process has become popular to cope with demands for saving energy and remarkably shortening the process time.

It is well known that, in order to obtain a cold-rolled steel sheet having excellent press-formability, it is preferred to use a low-carbon steel or a ultra-low-carbon steel having a C content not higher than 0.01% and to add a carbide former such as Ti, Nb and Zr and a nitride former such as Al and B so as to form carbides and nitrides thereby to fix solid C and N dissolved in the steel when necessary.

Cold-rolled steel sheets produced by such a process, however, involve a problem in that, when such sheets are subjected to a zinc-phosphatizing process conducted as an under-coat treatment, the crystal grains of the film of phosphate become coarse or the precipitation of crystal grains of phosphate is locally failed with the result that the corrosion resistance after painting is reduced to such a level that can hardly be accepted when the sheets are intended for use on automobiles.

It has also been noticed that ultra-low-carbon steel tends to have a coarse structure in heat affected zone by welding, with the result that the strength in such zone becomes lower than that in the weld region or matrix. Thus, ultra-low-carbon steel is inferior to low-carbon Al killed steels in the aspects of strength and fatigue characteristic in welded portion.

Furthermore, ultra-low-carbon steel, which has a high ductility and, hence, large stickiness, tends to exhibit burrs in edges formed by shearing or punching when the shearing or punching is conducted under the same conditions as that for low-carbon Al killed steel. The burrs which have come off in the subsequent pressing step tend to cause flaws such as star-like defects. A demand therefore exists for improvement in punching characteristic of ultra-low-carbon steel.

Improvement in workability is essentially accompanied by a reduction in the amount of impurity elements to the surface region. Condensation of elements in the steel during annealing is reduced to lower the hardness at the surface of the steel sheet. Therefore, when such a steel sheet is worked by a press, defects tend to be generated in the surface of the steel sheet due to biting of the press die into the surface of the steel sheet and, in the worst case, the steel sheet may be cracked, unless the surfaces of the steel sheet are sufficiently lubricated.

As effective measures for obviating these problems, methods have been proposed in Japanese Patent Publication No. 1-42331 and in Japanese Patent Laid-Open Nos. 63-38556 and 2-133561 in which properties of surface regions of steel strips are changed by effecting carburization and nitriding on only the surface regions of the steel strips.

These literatures, however, do not at all show any equipment which continuously produces cold-rolled steel sheets, for press working, which contains dissolved C and N only in their surface regions.

Meanwhile, Japanese Patent Laid-Open No. 47-29230 discloses an apparatus for continuously carburizing or nitriding steel members. This apparatus, however, is intended to treat non-flat members and is not applied to continuous treatment of steel strips.

Japanese Patent Publication No. 55-26708, corresponding to U.S. Pat. No. 3,950,192, discloses a method for continuously carburizing a low-carbon steel strip. The continuous line used in this method has a pre-heating furnace, a carburizing furnace, a soaking furnace and a cooling furnace which are arranged in the mentioned order, in contrast to the present invention. Thus, in the method disclosed in Japanese Patent Publication No. 55-26708, the steel strip which has been carburized is heated in the soaking furnace at a temperature falling in austenitization temperature range, thereby causing carbon to be uniformly dispersed throughout the whole steel strip.

In order to effect a continuous carburizing on the surface of a steel sheet such that a desired amount of dissolved carbon exists only in the surface region of a predetermined depth from the surface, it is necessary that the steel sheet after annealing be carburized in a short time, e.g., within several tens of seconds, followed by quenching for preventing diffusion of carbon.

Practical carburization and nitriding of cold-rolled steel sheets in an industrial scale are most conveniently carried out by a carburizing/nitriding furnace which is equipped between a heating furnace and a cooling furnace in a continuous annealing line and maintained in a suitable temperature range. In this case, the velocity at which the steel sheet passes the continuous annealing line is determined by heat treatment which determines quality o the steel sheet itself. Therefore, carburizing-/nitriding conditions are to be determined in accordance with the given annealing line velocity. The carburizing/nitriding conditions also have to be suitably changed in accordance with any change in the specifications of the steel sheet, such as material standards and dimensions. Furthermore, carburization and nitriding themselves have to adapt to different specifications of production.

In the carburization which is conducted in a short time, the reaction rate of solid-solution of carbon into steel is determined by the reaction on the surface of the steel sheet, so that a change in the carburization time, which is caused by any change in the velocity of passage of steel sheet in the continuous annealing line, significantly affects the concentration and depth of carburization.

SUMMARY OF THE INVENTION

Accordingly, an object of the present invention is to provide a continuous annealing line which can continuously carburize and/or nitride steel strips, particularly strips of ultra-low-carbon steel, during annealing and which can quickly and highly accurately change the carburizing and nitriding atmospheres in response to any change in the velocity at which the steel strip passes through the annealing line, thereby overcoming the above-described problems of the prior art.

To this end, according to the present invention, there is provided a continuous annealing line having a heating furnace with or without a soaking furnace connected thereto, for heating a cold-rolled steel sheet continuously supplied thereto, and a cooling furnace for cooling the heated steel sheet, characterized by comprising a carburizing/nitriding furnace provided between the heating furnace or the soaking furnace and the cooling furnace and arranged for continuously carburizing and/or nitriding the steel sheet.

In one form of the present invention, the carburizing/nitriding furnace is divided into a plurality of zones and control means are provided for controlling the carburizing and/or nitriding atmosphere or the carburizing and/or nitriding temperature in each of such zones.

In a specific form of the present invention, the line further comprises a plurality of carburizing/nitriding furnaces each capable of carburizing/nitriding and cooling for conducting a switching between a mode in which said carburizing/nitriding furnaces are used for carburizing/nitriding said steel strip and a mode in which said carburizing/cooling furnaces are used for cooling said steel strip.

The above and other objects, features and advantages of the present invention will become clear from the following description of the preferred embodiments when the same is read in conjunction with the accompanying drawings.

DESCRIPTION OF THE PREFERRED EMBODIMENT

An embodiment of the present invention will be described hereinafter with reference to the accompanying drawings.

Figure 1:
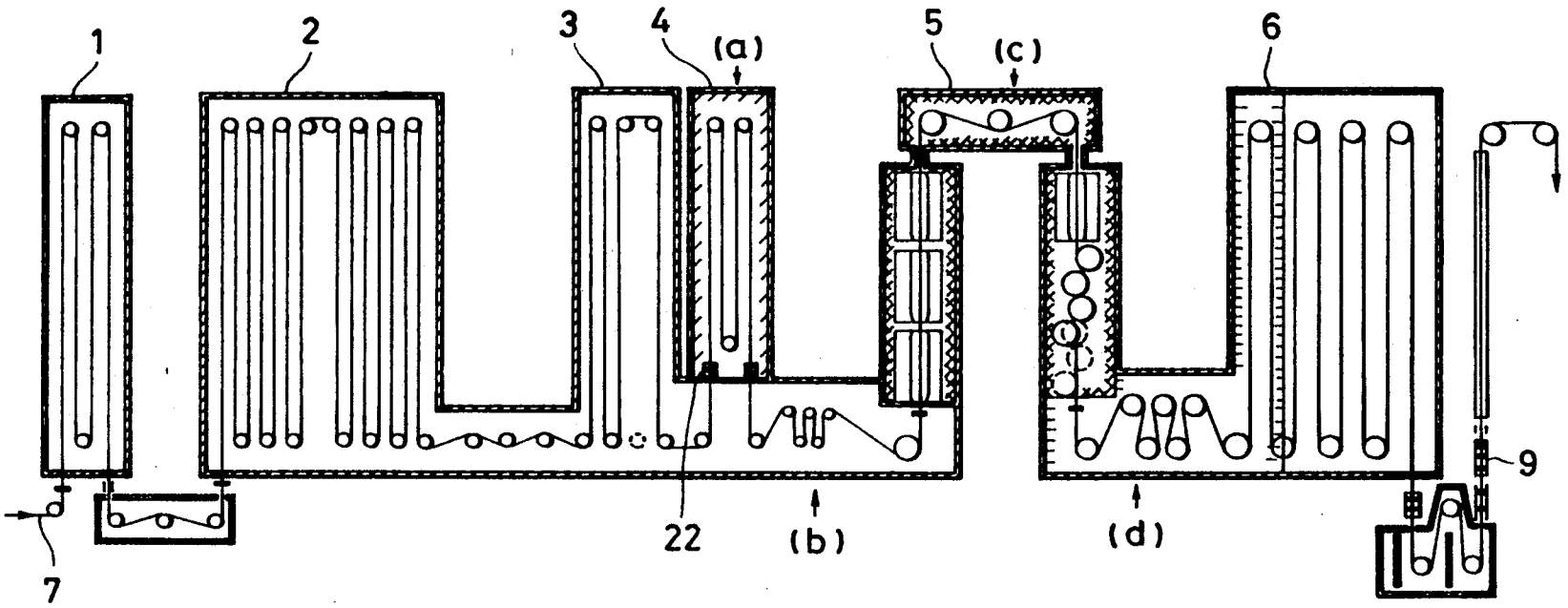
FIG. 1 is a cross-sectional view of a vertical continuous annealing line in accordance with the present invention.

Referring first to FIG. 1 which is a schematic cross-sectional view of a vertical continuous annealing line, the line is connected at its inlet side to a series of equipments such as an uncoiler, a welder and a rinsing apparatus which are not shown. The vertical continuous annealing line has a pre-heating furnace 1, a heating furnace 2, a soaking furnace 3, a carburizing furnace 4, a first cooling furnace 5 and a second cooling furnace 6. The vertical continuous annealing line is connected at its outlet side to a series of equipments such as a shear, a coiler and so forth which are not shown.

The above-described arrangement of furnaces provides a critical feature of the invention.

Namely, according to the present invention, the required recrystallization is effected in the heating furnace or the combination of the heating furnace and the soaking furnace and, thereafter, carburizing and/or nitriding are effected while controlling the steel sheet temperature, atmospheric condition, strip moving velocity (furnace residence time) and the cooling condition to provide the desired concentration and depth of carburizing and/or nitriding.

The invention will be more fully described with reference to FIGS. 2 onwards.

Figure 2:
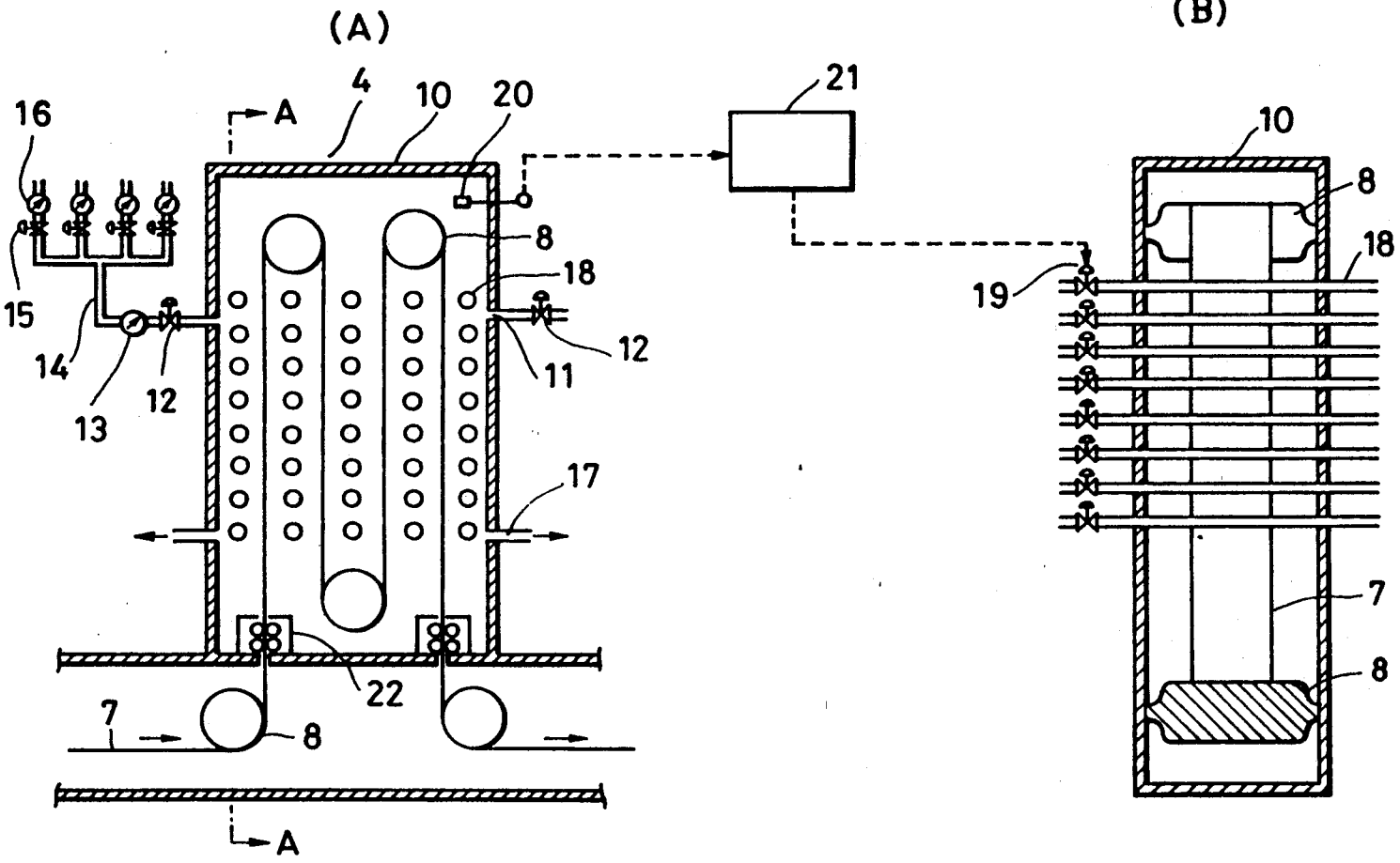
FIG. 2A is a schematic cross-sectional view of a carburizing/nitriding furnace in accordance with the present invention.
FIG. 2B is a sectional front elevational view as viewed in the direction of arrows A—A of FIG. 2A.

FIG. 2 shows a carburizing furnace 4 arranged in accordance with the invention between a known soaking furnace 3 and a cooling furnace 5.

The carburizing furnace 4 has a shell 10 made of refractory bricks and provided with an atmosphere gas supply port 11 formed in one of the walls thereof. An atmosphere gas supply pipe 14 having an atmosphere gas flow-rate control valve 12 and an atmosphere gas flowmeter 13 is connected to the gas supply port 11.

The atmosphere ga supply pipe 14 is branched into component gas pipes which lead to sources of component gases such as CO, $CO_2$, $H_2$ and $N_2$. A component gas flow-rate control valve 15 and a component gas flowmeter 16 are provided on the outlet of each component gas source.

The carburizing furnace 4 is adapted to be supplied with a carburizing gas which has, for example, a composition containing 5 to 10 vol % of CO, 2 to 4 vol % of $H_2$, the ratio $CO/CO_2$ ranging between 15 and 20, and the balance $N_2$. The carburizing gas is supplied into the carburizing furnace at a rate which is not less than 1000 $Nm^3/hr$.

An atmosphere gas discharge port 17 opens in a lower portion of the furnace.

In order to build up and maintain a predetermined temperature in the carburizing furnace, a radiant tube or a heater denoted by 18 is installed in this furnace. A control valve 19 or the like means is provided for controlling the rate of supply of a fuel gas to the radiant tube or electrical current supplied to the heater.

The temperature in the carburizing furnace is measured by, for example, a pyrometer such as a thermocouple 20.

In the illustrated embodiment, the control of the carburizing atmosphere in the carburizing furnace 4 includes control of the atmosphere temperature performed by the aforementioned radiant tube or heater 18, control flow rate of the atmosphere gas and control of the composition of the atmosphere gas.

In operation, the velocity of movement of the steel strip 7 is continuously monitored by a velocity sensor 9 and the temperature, flow rate and the composition of the atmosphere gas are controlled automatically through a feedback control conducted on the basis of data stored in a memory table of a computer 21 in accordance with the monitored moving velocity of the steel strip.

Hearth rolls 8 along which the steel strip 7 is fed are disposed in the carburizing furnace. Sealing devices 22 are provided at the entrance and exit of the carburizing furnace to prevent the carburizing atmosphere gas from leaking outside.

A description will now be given of a practical example.

A steel containing 0.0027 wt% of C, 0.01 wt% of Si, 0.10 wt% of Mn, 0.011 wt% of P, 0.008 wt% of S, 0.041 wt% of A, 0.006 wt% of Nb and the balance Fe and incidental inclusions was prepared in a converter. The steel was then continuously cast in an RH gas atmosphere, whereby a continuous steel slab was obtained.

The slab was heated-up to 1200° C. and was hot-rolled to a final temperature of 890° C. The slab was then taken up at 540° C., whereby a hot-rolled steel strip was obtained. The hot-rolled steel strip thus obtained was pickled and cold-rolled at a rolling reduction of 75%, whereby a cold-rolled steel strip of 0.8 mm thick was obtained.

Figure 3:
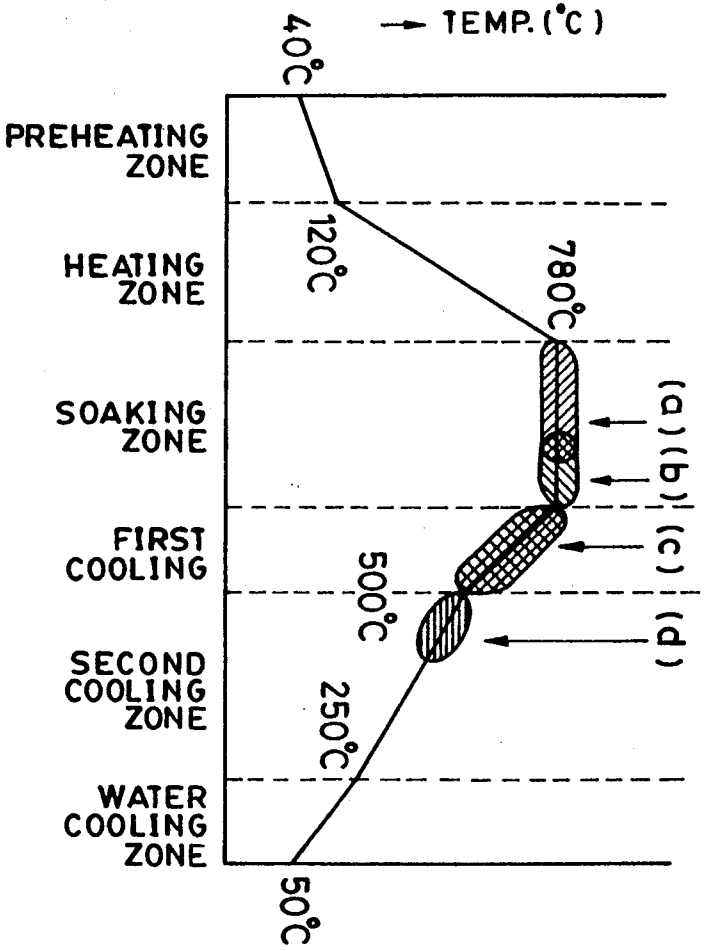
FIG. 3 is a graph showing the heat cycle of a steel sheet continuously annealed by the continuous annealing line of the present invention.

The thus-obtained cold-rolled steel strip was continuously annealed in the continuous annealing line shown in FIG. 1 in accordance with the heat cycle as shown in FIG. 3. In FIG. 3, temperature ranges (a), (b), (c) and (d) respectively correspond to the points (a), (b), (c) and (d) in the continuous annealing line shown in FIG. 1. Namely, in FIG. 3, the temperature range (a) is the range of temperature of the cold-rolled steel strip in the carburizing furnace, the temperature range (b) is the range of temperature of the cold-rolled strip at the outlet of the carburizing furnace, the temperature range (c) is the range of temperature of the cold-rolled steel strip in the first cooling furnace, and the temperature range (d) is the range of temperature of the cold-rolled strip at the outlet of the first cooling furnace.

In the continuous annealing conducted in this example, the carburizing was effected in the carburizing furnace 4 maintaining a carburizing atmosphere gas containing 9.5 vol% of CO, 3.0 vol% of $H_2$ and the balance $N_2$ and supplied at a rate of 1000 $Nm^3$/hr. The carburizing temperature and the carburizing time were respectively 780° C. and 20 seconds. The carburized steel strip was then cooled in the first cooling furnace at a cooling rate of 20° C./sec, until the steel temperature at the outlet of the first cooling furnace comes down to 500° C.

The same steel strip as that used in this example was continuously annealed without carburizing, for a comparison purpose.

The cold-rolled strips thus annealed were then examined and tested to determine the depth of carburizing, carbon concentration in the condensed surface layer, the number of chemical conversion crystal nucleus, cross tensile strength, height of burrs formed by punching and coefficient of friction. The results are shown in Table 1.

As will be understood from Table 1, the continuous annealing line in accordance with the present invention can continuously provide cold-rolled steel sheet which is superior in press-formability and chemical conversion treating property.

TABLE 1

| | At slab top | At slab bottom | At slab bottom, without carburization |
|---|---|---|---|
| Carburization depth (μm) | 72 | 77 | — |
| C concentration in condensed layer surface (wt %) | 0.010 | 0.012 | (0.003) |
| Number of chemical conversion crystal nucleus ($N/4 \times 10^{-6}$ $cm^{-2}$) | 102 | 112 | 38 |
| Cross tensile strength (Vgf) | 406 | 402 | 330 |
| Height of burr formed by punching (μm) | 20 | 20 | 60 |
| Friction coefficient (μ) | 0.17 | 0.17 | 0.40 |

Although an embodiment having a carburizing furnace has been described, this is not exclusive and the continuous annealing line of the present invention can employ a nitriding furnace in place of the carburizing furnace.

It is also to be understood that the same furnace can be used both as a carburizing furnace and a nitriding furnace by changing the treating atmosphere. For instance, an ($N_2+H_2$) gas containing $NH_3$ or other mixtures of gas can be used as the nitriding atmosphere. The carburizing furnace in the continuous annealing line of the present invention also may be arranged as a carburizing/nitriding furnace in which the steel strip is not only carburized but also nitrided.

In practical operation of the continuous annealing line of the present invention, variation in the velocity of the steel strip passing through the furnace occurs frequently due to changes in the factors such as the heat-treating conditions, material standard and size of the steel strip, carburizing and nitriding conditions required by the specifications, and so forth. The continuous annealing line, therefore, is required to cope with such frequent changes in the velocity of the steel strip.

Figure 4:
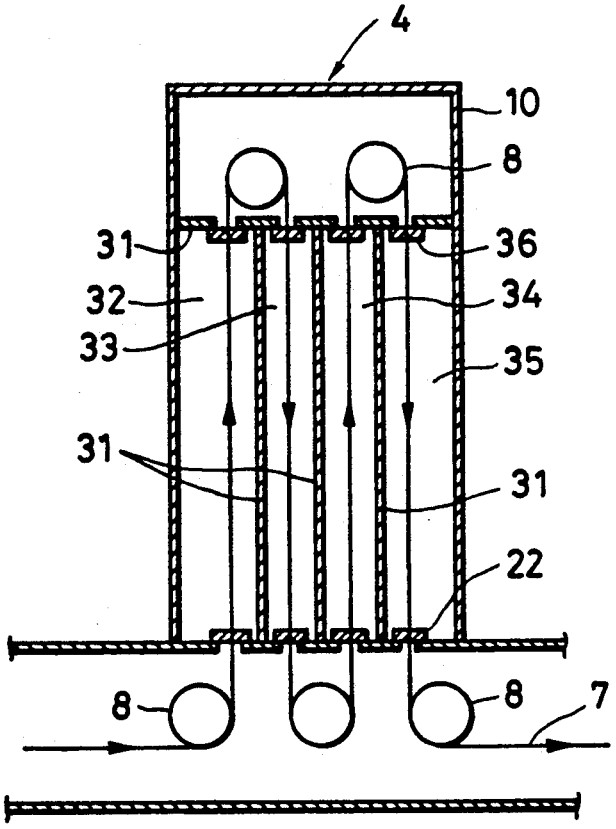
FIG. 4 is a schematic cross-sectional view of a plurality of carburizing/nitriding zones.
Figure 5:
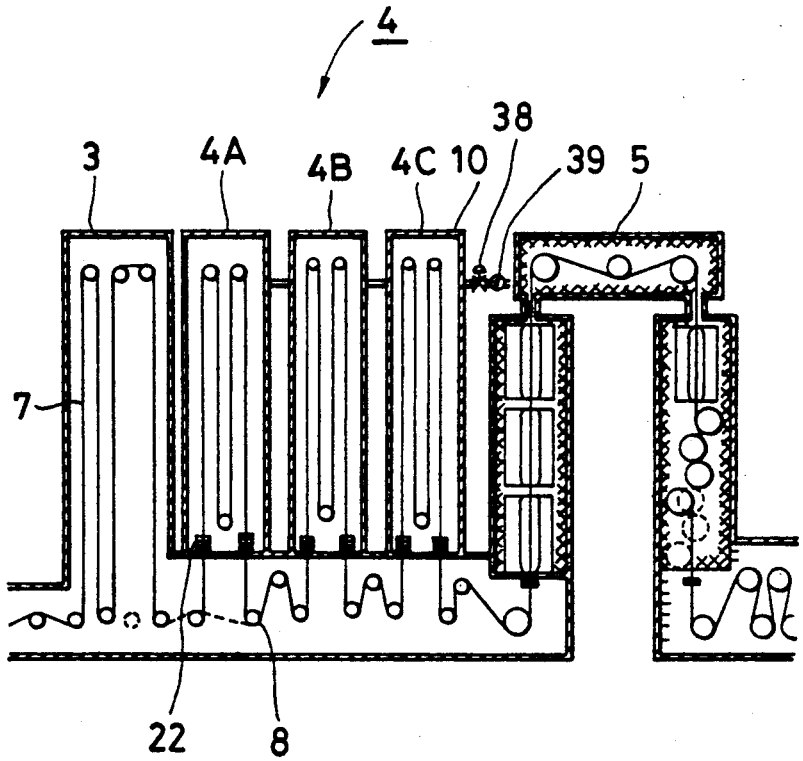
FIG. 5 is a cross-sectional view of a plurality of carburizing/nitriding furnaces having functions for carburizing/nitriding and cooling.
Figure 6:
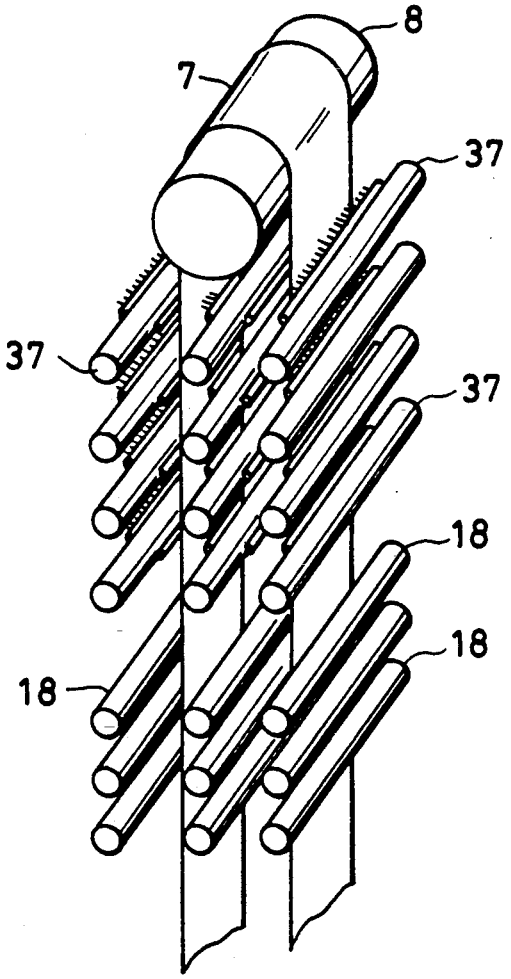
FIG. 6 is a perspective view of a portion of the furnace shown in FIG. 5.

FIGS. 4, 5 and 6 show examples of arrangements which can cope with such a demand.

Referring first to FIG. 4, the carburizing furnace 4 is divided into a plurality of zones, at least one of which is controlled so that no carburizing gas not nitriding gas is introduced into such a zone, thereby enabling the effective length of the carburizing and nitriding furnace.

According to the invention, it is possible to avoid any excessive carburizing and/or nitriding of the steel strip, as well as any insufficiency of the same, despite a reduction or an increase in the velocity of the steel strip passing through the continuous annealing line.

More specifically, in the embodiment shown in FIG. 4, the carburizing furnace is divided by heat-insulating partition walls 31 into four zones: namely, first to fourth zones 32 to 35. Sealing devices 36 are provided in the entrance and exit of each zone through which the steel strip 7 moves into and out of the zone, so as to prevent the treating atmospheres in adjacent zones from mixing in each other and to prevent the temperature of treating atmosphere in each zone from being affected by the temperatures of adjacent zones. Other portions ar materially the same as those shown in FIG. 2.

In the continuous annealing line having the carburizing furnace 4 as shown in FIG. 4, the composition and/or the temperature of the carburizing atmosphere is controlled in accordance with the velocity of the steel strip 7 passing through the line.

For instance, a reduction in the velocity of the steep strip passing through the line causes the residence time of the steel strip in the carburizing furnace correspondingly. If the carburizing condition is maintained without being changed, the carburizing is effected too heavily, causing various problems such as deterioration in the press formability. In order to avoid such excessive carburizing, therefore, it is necessary to conduct the following control.

The atmosphere gas flow rate control valve 12 for one of the zones is fully closed to terminate the supply of the atmosphere gas to this zone, to reduce the effective length of the line. As a consequence, the time over which the steel strip is subjected to carburizing is shortened to avoid excessive carburizing. Alternatively, the atmosphere gas flow rate control valves 12 for one, two or more of the zones are operated in closing direction to reduce the rates of supply of the atmosphere gas, thereby suppressing the tendency for excessive annealing. It is also possible to avoid excessive carburizing by lowering the C potential of the atmosphere gas supplied to one, two or more zones, by changing the composition of the atmosphere gas through operating the flow rate control valves for the respective component gases. Excessive carburizing can be avoided also by lowering the temperature or temperatures in one, two or more zones, through suitable control of rates of supply of the fuel gas or electric current to the radiant tubes or heaters in these zones. It will be understood that carburizing can be conducted to maintain the required level of carbon concentration and the thickness of the carburized layer regardless of any change in the velocity of movement of the steel strip in the line, by employing one, two or more of the above-described controls. Obviously, the described control or controls can be effected in response to changes in other conditions of the continuous annealing such as changes in the thickness, width and material of the steel strip.

FIG. 5 shows a sectional view of a carburizing/cooling furnace incorporated in an embodiment of the continuous annealing line of the present invention, while FIG. 6 is a perspective view of a portion of the carburizing/cooling furnace.

As will be seen from FIG. 5, the carburizing/cooling furnace has a plurality of furnaces 4A to 4C. In each of these furnaces, a plurality of cooling nozzles 37 and a plurality of radiant tube 18 are alternately arranged at both sides of the steel strip 7. The cooling nozzles 37 are arranged such that a cooling gas impinges upon the surfaces of the steel strip 7 substantially at a right angle thereto. The cooling nozzles 37 are adapted to be supplied with a cooling gas through a pipe which has a cooling gas flow rate control valve 38 and a cooling gas flowmeter 39. Other portions are materially the same as those shown in FIG. 2.

A velocity sensor 9 continuously monitors the velocity of passage of the steel strip 7. A computer 21 functions as a controller which determines whether the furnace 4 is to be used as a carburizing furnace or a cooling furnace on the basis of the content of a memory table set in the memory table and in accordance with the velocity of passage of the steel strip sensed by the velocity sensor 9. The control performed by the control means is conducted at a high response speed and with good controllability by changing the composition of the atmosphere gas in each furnace, in such a manner as to obviate any excessive carburizing or insufficiency of carburizing which may otherwise be caused by the change in the velocity of the steel strip passing through the line.

The switching of the carburizing/cooling furnace between the carburizing mode and the cooling mode is effected by controlling the temperature by the radiant tube 18 and operations of the atmosphere gas flow rate control valve 12 and the cooling gas flow rate control valve 38. For instance, when the carburizing/cooling furnace 4 is switched from the carburizing mode to the cooling mode, the atmosphere gas flow rate control valve 12 is closed and the supply of fuel gas to the radiant tube 18 is stopped, while the cooling gas flow rate control valve 38 is opened to introduce the cooling gas into the furnace 4, whereby the temperature in the furnace 4 is lowered to enable the furnace 4 to function as a cooling furnace.

The switching between the carburizing mode and the cooling mode is effected for each of the furnaces independently, thus attaining a highly accurate control with a high speed of response to any change in the velocity of the steel strip passing through the line.

Preferably the carburizing/cooling furnace 4 is designed to pass the steel strip 7 vertically, in order to meet the demand for reduction in the installation area. Thus, in the carburizing/cooling furnace 4, the switching of the carburizing/cooling furnace 4 between the carburizing mode and the cooling mode is conducted in accordance with the velocity of the steel strip which passes through this furnace 4.

For instance, when the velocity of the steel strip 7 has come down below ordinary velocity, the residence time of the steel strip in the carburizing/cooling furnace is increased correspondingly so that the steel strip 7 is excessively carburized unless a suitable measure is taken. Namely, in order to prevent such excessive carburizing, it is necessary to reduce the effective length of the carburizing furnace in the line so as to shorten the carburizing time. Such a reduction in the effective length of the carburizing furnace can be attained by switching at least one of the furnaces of the carburizing-/cooling furnace 4 into the cooling mode. It is therefore possible to form a carburized layer of a constant thickness regardless of any change in the velocity at which the steel strip passes through the line. Obviously, the switching of the carburizing/cooling furnace between the carburizing mode and the cooling mode may be effected in accordance with changes in other conditions of the continuous annealing, such as changes in thickness, breadth and material of the steel strip.

In order that a carburized layer having a C content not smaller than 0.01 wt% is formed in an extremely thin surface region between 0.5 and 100 μm or smaller, the atmosphere of the steel strip in the carburizing-/cooling furnace 4 used as a carburizing furnace is controlled to fall within a range between 650° and 900° C. Any steel strip temperature below 650° C. reduces the heat-treating efficiency due to a too slow carburization rate. On the other hand, when the steel strip temperature exceeds 900° C., dissolved C is diffused without being fixed in the surface region.

In order to prevent sooting on the steel strip surface, the temperature distribution in the carburizing furnace is preferably determined so that the difference between the highest and lowest temperatures in this furnace is not greater than 50° C. Deposition of free carbon on the surface of the steel strip causes various problems such as deterioration in the chemical conversion treating property and degradation of the product quality, and hampers subsequent steps of the process.

The carburizing/cooling furnace 4, when used as the cooling furnace, is controlled as a portion of the subsequent first cooling furnace 5 under the supply of the same atmosphere as that in the first cooling furnace 5. More specifically, the steel strip 7 after the carburizing is cooled quickly through the carburizing/cooling furnace 4 functioning as the cooling furnace and through the first cooling furnace 5, at a cooling rate not smaller than 20° C./sec., until the temperature is lowered to 600° C. or below, preferably to 500° to 400° C. In the carburizing/cooling furnace 4 and the first cooling furnace 5, the rate of the cooling gas blown on the steel strip 7, velocity of the cooling gas, temperature of cooling rolls and winding angle are suitably controlled to realize the above-described cooling effect.

Obviously, the cooling is conducted in the first cooling furnace alone when the whole carburizing/cooling furnace is used in carburizing mode.

As has been described, according to the present invention, a carburizing/nitriding furnace for carburizing and/or nitriding a cold-rolled steel strip is disposed between the heating furnace and the cooling furnace of the continuous annealing line. The carburizing/nitriding furnace is sectioned into a plurality of furnaces or is arranged so as to be usable also as a cooling furnace. It is therefore possible to quickly and accurately change the carburizing/nitriding atmosphere and/or the carburizing/nitriding temperature and to obtain a desired effective length of the carburizing/nitriding furnace.

By using the continuous annealing line of the present invention, therefore, it is possible to continuously and efficiently obtain a cold-rolled ultra-low-carbon steel strip which is superior in press-formability, chemical conversion property weldability and punching characteristic.

Although the invention has been described through its preferred forms, it is to be understood that the described embodiments are only illustrative and various changes and modifications may be imparted thereto without departing from the scope of the invention which is limited solely by the appended claims.

What is claimed is:

1. A continuous annealing line for annealing a cold-rolled steel strip, comprising:

a heating vertical furnace for heating said steel strip which is fed continuously, with or without a soaking furnace following said heating furnace;

a cooling vertical furnace in which the heated steel strip is cooled; and a carburizing/nitriding vertical furnace disposed between said heating furnace or said soaking furnace and said cooling furnace.

2. A continuous annealing line according to claim 1, wherein said carburizing/nitriding furnace is divided into a plurality of zones, each of which is provided with control means for controlling the carburizing/nitriding atmosphere and carburizing/nitriding temperature in said zone.

3. A continuous annealing line according to claim 1, further comprising a plurality of carburizing/nitriding furnaces each capable of carburizing/nitriding and cooling for conducting a switching between a mode in which said carburizing/nitriding furnaces are used for carburizing/nitriding said steel strip and a mode in which said carburizing/cooling furnaces ar used for cooling said steel strip.

4. A continuous annealing line according to claim 1, wherein said cold-rolled steel strip is a cold-rolled strip of a very-low-carbon steel

* * * * *